US008104440B2

(12) United States Patent
Kwon et al.

(10) Patent No.: US 8,104,440 B2
(45) Date of Patent: Jan. 31, 2012

(54) CONTINUOUS VARIABLE VALVE LIFT DEVICE

(75) Inventors: Ki Young Kwon, Seoul (KR); Young Hong Kwak, Suwon-si (KR); Eun Ho Lee, Hwaseong-si (KR); Soo Hyung Woo, Yongin-si (KR); Young Nam Kim, Sungnam-si (KR); Jin Kook Kong, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 574 days.

(21) Appl. No.: 12/330,323

(22) Filed: Dec. 8, 2008

(65) Prior Publication Data

US 2009/0288622 A1 Nov. 26, 2009

(30) Foreign Application Priority Data

May 22, 2008 (KR) ..... 10-2008-0047574

(51) Int. Cl.
*F01L 1/34* (2006.01)

(52) U.S. Cl. ..... 123/90.16; 129/90.39

(58) Field of Classification Search ..... 123/90.15, 123/90.16, 90.39
See application file for complete search history.

(56) References Cited

U.S. PATENT DOCUMENTS

2006/0112917 A1* 6/2006 Nakamura et al. ..... 123/90.16
2007/0095311 A1 5/2007 Tateno et al.

FOREIGN PATENT DOCUMENTS

JP 05-332110 12/1993
JP 2001-234721 A 8/2001
JP 2006-152926 A 6/2006

* cited by examiner

*Primary Examiner* — Zelalem Eshete
(74) *Attorney, Agent, or Firm* — Morgan, Lewis & Bockius LLP

(57) ABSTRACT

The CVVL device includes a rocking cam having a rolling face contacting a rocker arm is formed to press the rocker arm when pivoted, a rocking roller, which is disposed above the drive cam and rolls on an outer circumference of the drive cam, a control apparatus, which changes a position of the rocking roller rolling on the outer circumference of the drive cam; and a rocking apparatus, which pivots the rocking cam according to a position of the rocking roller such that a position where the rocker arm is contacted with the rolling face is changed depending on the position of the rocking roller.

18 Claims, 5 Drawing Sheets

CONTINUOUS VARIABLE VALVE LIFT DEVICE

CROSS-REFERENCE TO RELATED APPLICATION

The present application claims priority to Korean Patent Application No. 10-2008-0047574 filed May 22, 2008, the entire contents of which applications is incorporated herein for all purposes by this reference.

BACKGROUND OF THE INVENTION

1. Field of the Invention

The present invention relates to a continuous variable valve lift (CVVL) device in which a valve has simultaneously variable lift time and distance depending on the low-speed/high-speed operating range of an engine and, more particularly, to a CVVL device which can be mounted on a CCVL-device-free engine, i.e. a non-CVVL engine, without increasing a gap between a drive cam and a rocker roller.

2. Description of Related Art

As for an engine, a camshaft is rotated by a rotating force transmitted from a crank shaft, and an intake valve and an exhaust valve are reciprocated up and down with regular timing by cams of the camshaft. Thereby, intake air is supplied to a combustion chamber, and combustion gas is exhausted. In this process, a fuel-air mixture is compressed and exploded to generate power.

At this time, a device that can continuously vary the lift distance of a valve according to an operating speed of the engine is called a continuous variable valve lift (CVVL) device.

Hereinafter, a conventional CVVL device will be described in detail with reference to the attached drawings.

FIG. 1 is a side view illustrating the configuration of a conventional continuous variable valve lift (CVVL) device.

As illustrated in FIG. 1, the conventional CVVL device is a device that varies the pivoting angle of a rocker arm 30 depending on various conditions such as an engine speed when the rocker arm 30 is pivoted by rotation of a drive cam 20 coupled to a camshaft 10, and is mounted between the drive cam 20 and the rocker arm 30.

More specifically, the conventional CVVL device includes a first gear 50, a second gear 60, a rocking cam 70 pivoting around a control shaft 72 and pressing a rocker roller 32 of the rocker arm 30 according to a pivoting angle, and a rocking link 80 mounted between the drive cam 20 and the rocking arm 70 and pivoting the rocking cam 70 by means of rotation of the drive cam 20.

The rocking link 80 is hinged to the second gear 60 by a connection pin 82 at one end thereof, and is provided with a rocking roller 84 contacting a top face of the rocking cam 70 at the other end thereof. At this time, the first gear 50 and the second gear 60 serve to set at which portion of the top face of the rocking cam 70 the rocking roller 84 is located. The first gear 50 is configured to be able to be rotated around the control shaft 72, and the second gear 60 is configured to be able to be rotated around the camshaft 10.

Thus, when the rocking roller 84 is located at a right-hand end of the rocking cam 70, namely when the rocking roller 84 is located at a position remote from the pivoting center of the rocking cam 70, the pivoting angle of the rocking cam 70 is increased when the rocking roller 84 moves down by means of the drive cam 20, so that the lift distance of a valve 40 is increased.

In contrast, when the rocking roller 84 is located on a left-hand side of the rocking cam 70, namely when the rocking roller 84 is located at a position adjacent to the pivoting center of the rocking cam 70, the pivoting angle of the rocking cam 70 is decreased when the rocking roller 84 moves down by means of the drive cam 20, so that the lift distance of the valve 40 is decreased.

However, as described above, the conventional CVVL device is configured to be mounted between the drive cam 20 and the rocker arm 30. Thus, in the case in which the conventional CVVL device is to be applied to an engine on which the CCVL device is not mounted, i.e. a non-CVVL engine, positions of the drive cam 20 and the rocker arm 30 must be changed.

Further, if a gap between the drive cam 20 and the rocker arm 30 is increased, the total height of the engine is increased.

In addition, in the case of the conventional CVVL device configured as described above, when the control shaft 72 is pivoted in order to change a position of the rocking roller 84, a rotating force of the control shaft 72 is transmitted to the rocking link 80 via the first and second gears 50 and 60. Here, since the second gear 60 is configured to be pivoted around the camshaft 10, there is a possibility of the camshaft 10 being abnormally operated by friction between the second gear 60 and the camshaft 10.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention provide for a continuous variable valve lift (CVVL) device, in which a gap between the camshaft of a drive cam and a rocker arm does not need to be changed, thereby being suitable for a conventional non-CVVL engine without change, and which no friction against the camshaft is generated when a control shaft is rotated, thereby being able to prevent abnormal operation of the camshaft as well as increase in engine volume.

On aspect of the present invention may be directed to a continuous variable valve lift device including a rocking cam having a rolling face contacting a rocker arm formed to press the rocker arm when pivoted, a rocking roller disposed above a drive cam and in rolling contact with an outer circumference of the drive cam, a control apparatus, which adjusts a relative position of the rocking roller as it rolls along the outer circumference of the drive cam, and/or a rocking apparatus, which pivots the rocking cam according to a position of the rocking roller such that a position where the rocker arm may be contacted with the rolling face may be changed depending on the position of the rocking roller.

The rolling face may include a zero lift section that does not pivot the rocker arm when contacted with the rocker arm, and/or low and high lift sections that pivot the rocker arm at different angles. The low and high lift sections may be substantially linear.

The rocking apparatus may include an upper link contacting an outer circumference of the rocking roller, and/or a lower link linked with the rocking cam. The upper link and the lower link may be integrally formed. The upper link of the rocking apparatus may be supported by an elastic member. The rocking roller may be disposed between the upper link of the rocking apparatus and the drive cam.

The rocking cam may be pivotably mounted on a camshaft of the drive cam. The control apparatus may include a control shaft whose rotation angle may be regulated by a controller. The rocking apparatus may be pivotably coupled to the control shaft. A junction of the upper link and the lower link of the rocking apparatus may be pivotably coupled to the control shaft.

The control apparatus further may include a first link and a second link coupled each other wherein a first end of the first link may be coupled to rotation center of the rocking roller and second end of the second link may be coupled to the control shaft.

A continuous variable valve lift system may include any of the continuous variable valve lift devices described above.

The rolling face may include a zero lift section that does not pivot the rocker arm when contacted with the rocker arm, and/or low and high lift sections that pivot the rocker arm at different angles. The rocking apparatus may include an upper link contacting an outer circumference of the rocking roller, and/or a lower link linked with the rocking cam, wherein the upper link and the lower link may be integrally formed. The rocking cam may be pivotably mounted on a camshaft of the drive cam. The control apparatus may include a control shaft whose rotation angle may be regulated by a controller.

A passenger vehicle may include any of the continuous variable valve lift devices discussed above.

According to various aspects of the present invention, the CVVL device does not require a large mounting space between the camshaft of the drive cam and the rocker arm, so that it can be applied to a conventional non-CVVL engine without change. Further, the CVVL device does not generate friction against the camshaft is generated when the control shaft is rotated, so that it can prevent abnormal operation of the camshaft as well as increase in engine volume.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
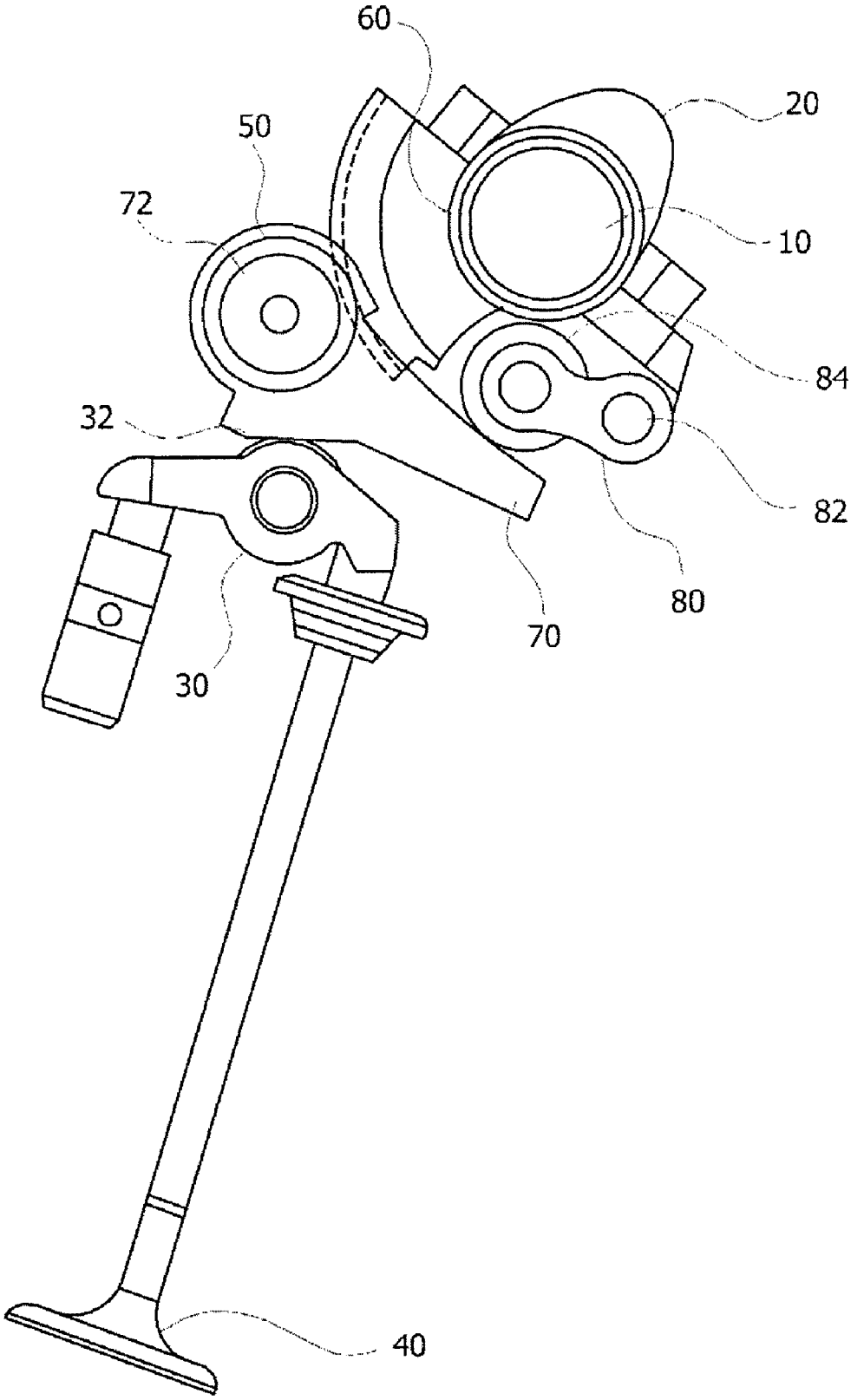
FIG. 1 is a side view illustrating the configuration of a continuous variable valve lift (CVVL) device.
Figure 2:
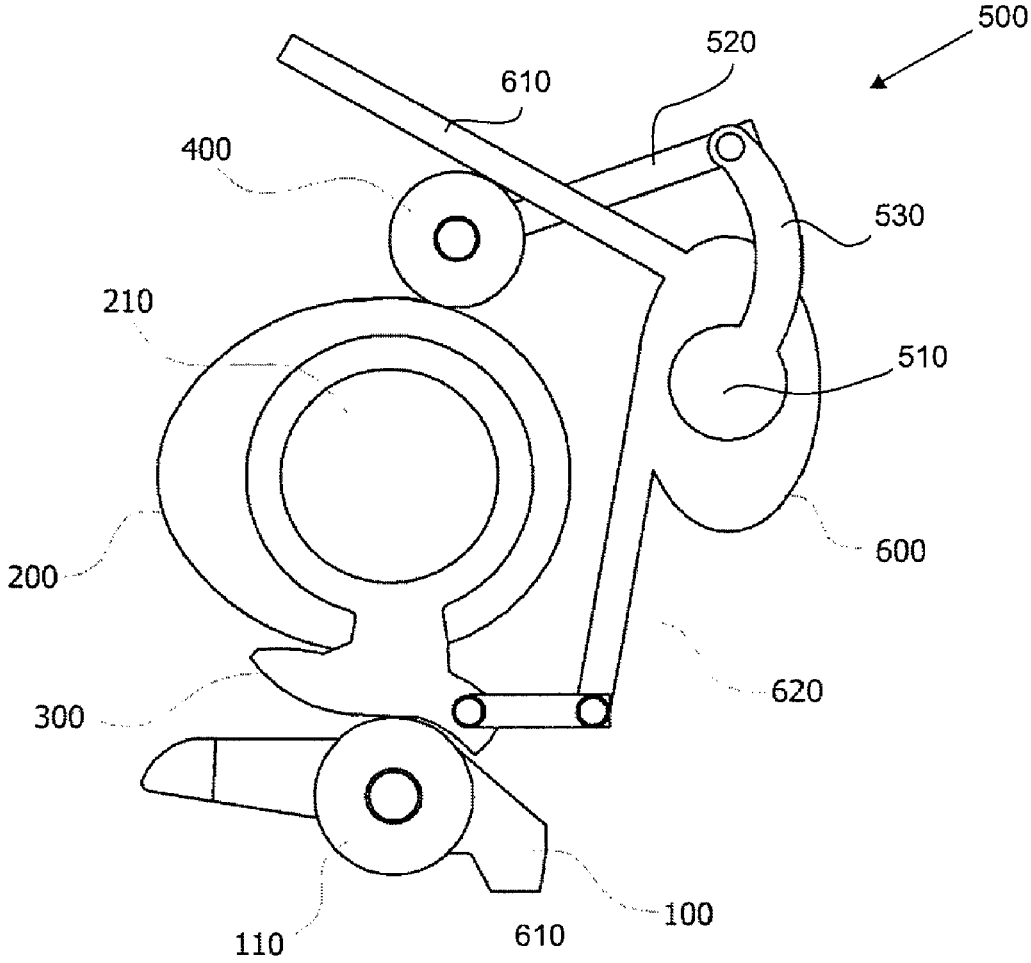
FIG. 2 is a schematic view illustrating the configuration of an exemplary CVVL device according to the present invention.
Figure 3:
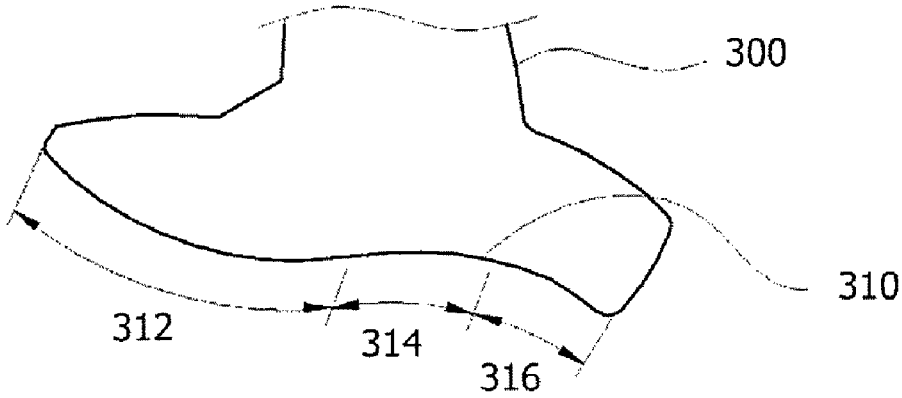
FIG. 3 is a partial enlarged view illustrating a rocking cam in an exemplary CVVL device according to the present invention.

FIG. 2 is a schematic view illustrating the configuration of a continuous variable valve lift (CVVL) device according to an exemplary embodiment of the present invention. FIG. 3 is a partial enlarged view illustrating a rocking cam in a CVVL device according to an exemplary embodiment of the present invention.

The major feature of the CVVL device of the present invention is that the pivoting angle and time of a rocker arm 100 can be controlled without increasing a gap between a drive cam 200 and a rocker arm 100, namely the lift distance and time of a valve coupled to the rocker arm 100 can be controlled.

In detail, as illustrated in FIG. 2, the CVVL device of the present invention includes a rocking cam 300 coaxially mounted on a camshaft 210, on a bottom face of which a rolling face 310 contacting the rocker arm 100 (particularly, a rocker roller 110 of the rocker arm 100) is formed to press the rocker arm 100 when pivoted, a rocking roller 400, which is disposed above the drive cam 200 and rolls on an outer circumference of the drive cam 200 coaxially mounted on the camshaft 210, a control apparatus 500 comprising a control shaft 510, which changes a position of the rocking roller 400 on the outer circumference of the drive cam 200, and a rocking apparatus 600, which pivots the rocking cam 300 such that a position where the rocker arm 100 is contacted with the rolling face 310 is changed depending on a position of the rocking roller 400.

Since the drive cam 200 configured to be able to be rotate around the camshaft 210 and the rocker arm 100 having the rocker roller 110 are substantially the same as those applied to an engine on which the CVVL device is not mounted, i.e. a non-CVVL engine, detailed description thereof will be omitted.

The rocking cam 300 is a component that presses the rocker arm 100 to open or close the valve coupled to the rocker arm 100. More specifically, the rocking cam 300 is designed to be pivoted in one direction (in the case of the illustrated embodiment, in a clockwise direction) so as to press the rocker arm 100 in a downward direction when the rocking roller 400 is contacted with a major-axial outer circumference of the drive cam 200 (i.e. an outer surface of a cam lobe of the drive cam 200), and thus is raised.

The rocking cam 300 may be designed so as to be pivoted around a rotating shaft separate from the camshaft 210. However, when the separate rotating shaft for pivoting the rocking cam 300 is installed, the CVVL device not only increases the cost of production due to increase in the number of parts, but also undergoes complexity in structure as well as difficulty in production. Thus, as illustrated in various embodiments, the rocking cam 300 is preferably mounted on the camshaft 210 in a pivotable structure. Further, in various embodiments, when the rotating shaft of the rocking cam 300 is configured to be aligned with the camshaft 210 of the drive cam 200, a gap between the rotating shaft of the rocking cam 300 and the rocker roller 110 may become narrow. Thus, a chance of deforming a mechanical structure is reduced, and control stability is increased.

Further, as illustrated in FIG. 3, the rolling face 310 formed on the bottom face of the rocking cam 300 includes a zero lift section 312 that does not pivot the rocker arm 100 when contacted with the rocker arm 100, and low and high lift sections 314 and 316 that pivot the rocker arm 100 at different angles. Thus, the valve coupled to the rocker arm 100 is not opened when the rocker arm 100 contacts the zero lift section 312, is slightly opened when the rocker arm 100 contacts the low lift section 314, and is fully opened the rocker arm 100 contacts the high lift section 316.

The rocking roller 400 is a component that generates a linear motion force according to a rotating angle of the drive cam 200, is always in contact with the outer circumference of the drive cam 200, and is linked to the control shaft 510 of the control apparatus 500 at the center of rotation thereof, so that the position of the rocking roller 400 rolling on the outer circumference of the drive cam 200 is controlled by an rotating angle of the control shaft 510. The rotation of control shaft 510 is activated by a controller.

Thus, the rocking roller 400 is raised when contacted with the major-axial portion, i.e. the cam lobe portion, of the outer circumference of the drive cam 200, and maintains the position illustrated in FIG. 2 without change when contacted with the other portion.

The rocking apparatus 600 is a component that pivots the rocking cam 300 with respect to the camshaft 210 as the rocking roller 400 is raised or lowered, and thereby pivots the rocker arm 100, and is mounted so as to be able to be rotated independent of the drive cam 200 or the rocker arm 100.

Further, the rocking apparatus 600 includes an upper link 610 continuing to contact the outer circumference of the rocking roller 400, and a lower link 620 linked with the rocking cam 300, wherein the upper link 610 and the lower link 620 are integrally connected. One will appreciate that the links may also be monolithically formed. In various embodiments of the present invention, the rocking roller 400 may be disposed between the drive cam 200 and the upper link 610. The rocking apparatus 600 rotates by the rocking roller 400 in a clockwise direction with respect to the control shaft 510 when the camshaft 210 rotates in clockwise direction and the rocking roller 400 is raised by the drive cam 200, thereby pivoting the rocking cam 300 in a clockwise direction.

In contrast, in case that the rocking roller 400 is lowered, the rocking apparatus 600 rotates in a counterclockwise direction by an elastic member (not shown), thereby pivoting the rocking cam 300 in a counterclockwise direction as explained later in detail. At this time, since the upper link 610 is always in contact with the rocking roller 400, the rocking apparatus 600 is preferably configured to receive elastic force so as to be rotated in a counterclockwise direction by the elastic member.

In various embodiments of the present invention, the rocking roller 400 may be pivotally supported by control apparatus 500 comprising the control shaft 510, a first link 520 and a second link 530. The rocking roller 400 is coupled to a first end of the first link 520 and second end of the first link 520 is coupled to first end of the second link 530. Second end of the second link 530 is connected to the control shaft 510.

The control shaft 510 is activated by a controller to control rotation angle of the control shaft 510 so as to regulate the position of the rocking roller 400 on the drive cam 200.

The control apparatus 500 is a component that changes the position of the rocking roller 400 on the outer circumference of the drive cam 200. The first link 520 of the control apparatus 500 is hinged to the center of rotation of the rocking roller 400 at one end thereof, and the second link 530 is coupled to the control shaft 510. Thus, in the state illustrated in FIG. 2, when the control shaft 510 rotates in a clockwise direction in a predetermined angle according to instruction of a controller, the rocking roller 400 rides on the outer circumference of the drive cam 200 to moves to the right-hand side. At the same time, the upper link 610 of the rocking apparatus 500 rotates in clockwise direction.

In contrast, when the control shaft 510 rotates in a counterclockwise direction in a predetermined angle, the rocking roller 400 rides on the outer circumference of the drive cam 200 to moves to the left-hand side. At the same time, the upper link 610 of the rocking apparatus 500 rotates in counterclockwise direction by the elastic member.

In this manner, as the rocking roller 400 rides on the outer circumference of the drive cam 200 to moves to the right-hand or left-hand side, the following effects are obtained, and will be described in detail with reference to FIGS. 4 through 6.

The CVVL device, in various embodiments of the present invention, has an advantage in that, since the rotating force of the control shaft 510 is directly transmitted to the rocking roller 400 without going through the camshaft 210, no frictional force is generated from the camshaft 210 when the control shaft 510 rotates.

Further, when the control apparatus 500 is located above or below the drive cam 200, the total height of the CVVL device is increased. As such, the control apparatus 500 is preferably located on the left-hand or right-hand side of the drive cam 200. Further, the rocking apparatus 600 may be configured to be able to be rotated around a rotating shaft different from the control shaft 510. In this case, the configuration may be complicated and the overall volume of the CVVL device may be increased. Thus, the rocking apparatus 600 is preferably coupled to the control shaft 510 in a pivotable structure.

Figure 4:
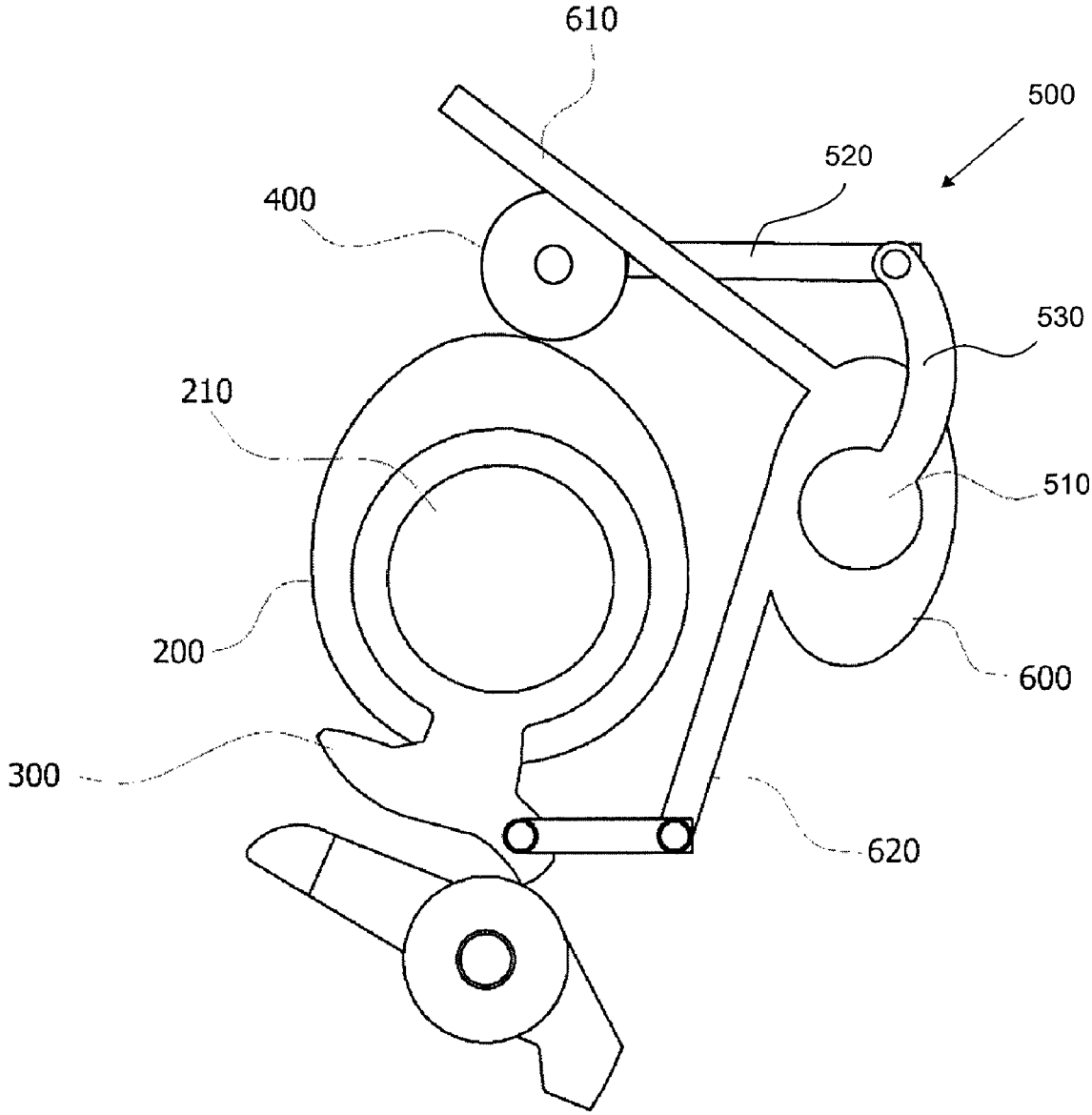
FIGS. 4 through 6 are schematic views sequentially illustrating the operation of an exemplary CVVL device according to the present invention.
Figure 5:
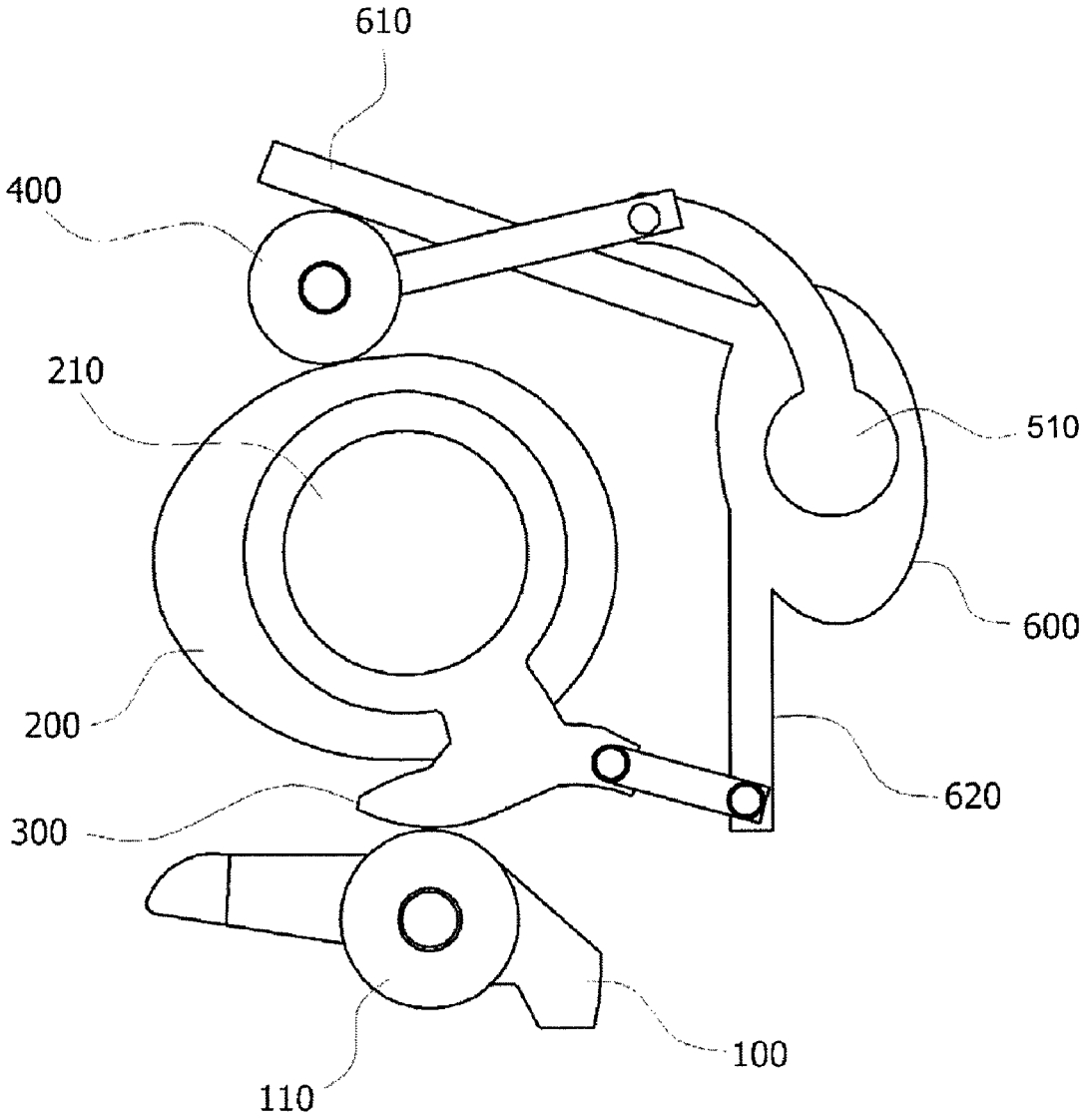
Figure 6:
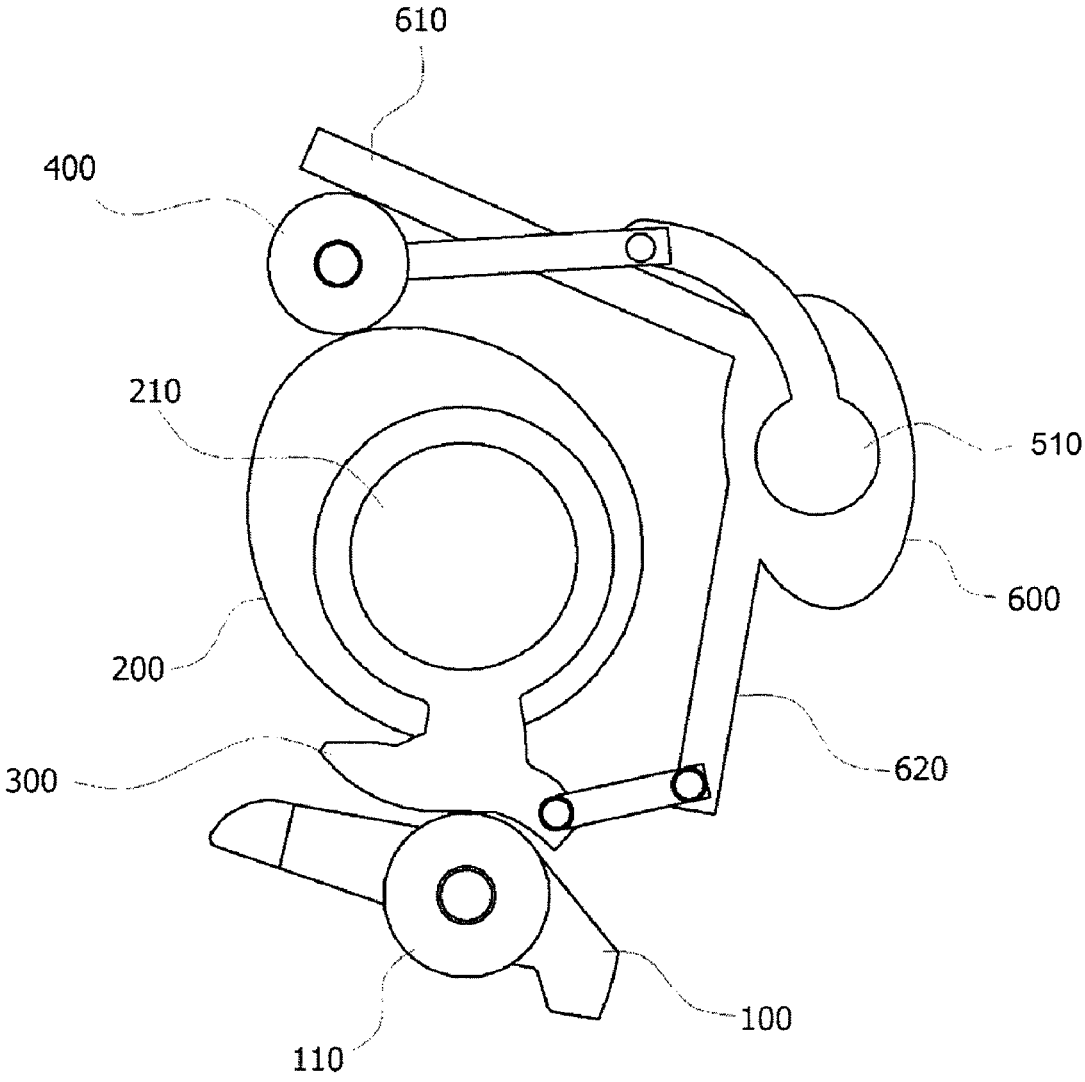

FIGS. 4 through 6 are schematic views sequentially illustrating the operation of a CVVL device according to an exemplary embodiment of the present invention.

In the state illustrated in FIG. 2, when the drive cam 200 is rotated in a clockwise direction, and thus the major-axial outer circumference of the drive cam 200 contacts the rocking roller 400, the rocking roller 400 is pushed upwards as illustrated in FIG. 4, and thereby one end of the upper link 610 engaged with the outer circumference of the rocking roller 400 is also raised in a clockwise direction. As a result, the rocking apparatus 600 rotates in a clockwise direction with respect to the control shaft 510.

In this manner, when the rocking apparatus 600 rotates in a clockwise direction, the rocking cam 300 linked to one end of the lower link 620 of the rocking apparatus 600 also rotates in a clockwise direction, and then the rocker arm 100 (particularly, the rocker roller 110) contacts the high lift section 316 of the rolling face 310 of the rocking cam 300, and thus rotates at a great angle. Thus, the lift distance of the valve coupled with the rocker arm 100 is increased.

Further, in the state illustrated in FIG. 2, when the control shaft 510 is rotated in a counterclockwise direction as illustrated in FIG. 5, the rocking roller 400 rides on the outer circumference of the drive cam 200 to moves to the left-hand side, and thus one end of the upper link 610, which is always engaged with the rocking roller 400, is lowered in a counterclockwise direction. As a result, the rocking apparatus 600 rotates in a counterclockwise direction with respect to the control shaft 510.

In this manner, when the rocking apparatus 600 rotates in a counterclockwise direction, the rocking cam 300 linked to one end of the lower link 620 also rotates in a counterclockwise direction. At this time, since the rocker arm 100 passes through the zero lift section 312 of the rolling face 310 of the rocking cam 300, the rocker arm 100 is not pivoted in any direction, and thus maintains the same state as the state illustrated in FIG. 2.

In the state illustrated in FIG. 5, when the drive cam 200 is rotated in a clockwise direction, and thus the major-axial outer circumference of the drive cam 200 contacts the rocking roller 400, the rocking roller 400 is pushed upwards as illustrated in FIG. 6, and thereby one end of the upper link 610 engaged with the outer circumference of the rocking roller 400 is also raised in an upward direction. As a result, the rocking apparatus 600 rotates in a clockwise direction with respect to the control shaft 510.

In this manner, when the rocking apparatus 600 rotates in a clockwise direction, the rocking cam 300 linked to one end of the lower link 620 of the rocking apparatus 600 also rotates in a clockwise direction, and then the rocker arm 100 (particularly, the rocker roller 110) contacts the low lift section 314 of the rolling face 310 of the rocking cam 300 past the zero lift section 312 as shown in FIG. 6, and thus rotates at a smaller angle compared to the state illustrated in FIG. 4. Thus, the lift distance of the valve coupled with the rocker arm 100 is decreased.

At this time, the rocking roller 400 is located nearer one end of the upper link 610 compared to the state illustrated in FIG. 4, namely at a position remote from the center of rotation, for example, the control shaft 510, of the rocking apparatus 600. Thus, although the rocking roller 400 is raised by the same height as the state illustrated in FIG. 4, it is rotated at a smaller angle compared to the state illustrated in FIG. 4. Thus, although the low and high lift sections 314 and 316 of the rolling face 310 are substantially linear, the rocker arm 100 is pivoted at a smaller angle as illustrated in FIG. 6 in the state in which the rocking roller 400 is contacted with one end of the upper link 610.

While the present invention has been described with reference to the particular illustrative embodiments and the accompanying drawings, it is not to be limited thereto. Accordingly, the foregoing embodiments can be suitably modified and altered, and such applications fall within the scope and spirit of the present invention that shall be defined by the appended claims.

For convenience in explanation and accurate definition in the appended claims, the terms "upper" or "lower", "front" or "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve lift device, comprising:

a rocking cam having a rolling face contacting a rocker arm formed to press the rocker arm when pivoted;

a rocking roller disposed above a drive cam and in rolling contact with an outer circumference of the drive cam;

a control apparatus, which adjusts a relative position of the rocking roller as it rolls along the outer circumference of the drive cam; and a rocking apparatus, which pivots the rocking cam according to a position of the rocking roller such that a position where the rocker arm is contacted with the rolling face is changed depending on the position of the rocking roller, wherein the rolling face includes:

a zero lift section that does not pivot the rocker arm when contacted with the rocker arm; and low and high lift sections that pivot the rocker arm at different angles, and wherein the low and high lift sections are substantially linear.

2. The continuous variable valve lift device according to claim 1, wherein the rocking apparatus includes:

an upper link contacting an outer circumference of the rocking roller; and a lower link linked with the rocking cam, wherein the upper link and the lower link are integrally formed.

3. The continuous variable valve lilt device according to claim 2, wherein the upper link of the rocking apparatus is supported by an elastic member.

4. The continuous variable valve lift device according to claim 2, wherein the rocking roller is disposed between the upper link of the rocking apparatus and the drive cam.

5. The continuous variable valve lift device according to claim 1, wherein the rocking cam is pivotably mounted on a camshaft of the drive cam.

6. A continuous variable valve lift system comprising the continuous variable valve lift device according to claim 1.

7. The continuous variable valve lift system according to claim 6, wherein the rolling face includes:

a zero lift section that does not pivot the rocker arm when contacted with the rocker arm; and low and high lift sections that pivot the rocker arm at different angles.

8. The continuous variable valve lift system according to claim 6, wherein the rocking apparatus includes:

an upper link contacting an outer circumference of the rocking roller; and a lower link linked with the rocking cam, wherein the upper link and the lower link are integrally formed.

9. The continuous variable valve lift system according to claim 6, wherein the rocking cam is pivotably mounted on a camshaft of the drive cam.

10. The continuous variable valve lift system according to claim 6, wherein the control apparatus comprises a control shaft whose rotation angle is regulated by a controller.

11. A passenger vehicle comprising the continuous variable valve lift device according to claim 1.

12. A passenger vehicle comprising the continuous variable valve lift system according to claim 6.

13. An engine comprising the continuous variable valve lift device of claim 1.

14. A passenger vehicle comprising the engine of claim 13.

15. The continuous variable valve lilt device according to claim 1, wherein the drive cam is configured to be able to be rotate around the control apparatus.

16. A continuous variable valve lift device, comprising:

a rocking cam having a rolling face contacting a rocker arm formed to press the rocker arm when pivoted;

a rocking roller disposed above a drive cam and in rolling contact with an outer circumference of the drive cam;

a control apparatus, which adjusts a relative position of the rocking roller as it rolls along the outer circumference of the drive cam; and a rocking apparatus, which pivots the rocking cam according to a position of the rocking roller such that a position where the rocker arm is contacted with the rolling face is changed depending on the position of the rocking roller, wherein the control apparatus comprises a control shaft whose rotation angle is regulated by a controller, wherein the control shaft is located on one of left-hand and right-hand sides of the drive cam, and wherein the rocking apparatus is pivotably coupled to the control shaft.

17. The continuous variable valve lift device according to claim 16, wherein a junction of the upper link and the lower link of the rocking apparatus is pivotably coupled to the control shaft.

18. The continuous variable valve lift device according to claim 16, wherein the control apparatus further comprises a first link and a second link coupled each other wherein a first end of the first link is coupled to rotation center of the rocking roller and second end of the second link is coupled to the control shaft.

* * * * *